US007069882B2

(12) United States Patent
Yonezawa et al.

(10) Patent No.: US 7,069,882 B2
(45) Date of Patent: Jul. 4, 2006

(54) WATER-COOLED ENGINE

(75) Inventors: Makoto Yonezawa, Wako (JP); Hiroki Tawa, Wako (JP); Yoshihiko Fukuda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/091,727

(22) Filed: Mar. 28, 2005

(65) Prior Publication Data

US 2005/0229874 A1 Oct. 20, 2005

(30) Foreign Application Priority Data

Mar. 30, 2004 (JP) ..... 2004-097845

(51) Int. Cl.
*F02F 1/10* (2006.01)

(52) U.S. Cl. ..... 123/41.72; 123/41.74

(58) Field of Classification Search ..... 123/41.72, 123/41.74
See application file for complete search history.

(56) References Cited

U.S. PATENT DOCUMENTS 4,312,304 A * 1/1982 Tyner ..... 123/41.74

FOREIGN PATENT DOCUMENTS

JP 61-167111 7/1986

* cited by examiner

*Primary Examiner*—Tony M. Argenbright
*Assistant Examiner*—Katrina Harris
(74) *Attorney, Agent, or Firm*—Carrier, Blackman & Associates, P.C.; Joseph P. Carrier; William D. Blackman

(57) ABSTRACT

In a water-cooled multi-cylinder vertical engine for an outboard engine system, cooling water having passed through an exhaust-manifold cooling water jacket for cooling an exhaust passage within an engine room is supplied to a cylinder-block cooling water jacket provided in a cylinder block through water supply pipes, a branching member and two upper and lower couplings. In this case, the lower coupling is locked below the center of a lowermost cylinder to minimize unevenness in flow rate of the cooling water flowing through a water jacket on opposite left and right sides of a cylinder toward a cooling water outlet provided at an upper portion thereof, thereby making uniform the distribution of the temperature around a combustion chamber, leading to an enhancement in cooling effect.

16 Claims, 7 Drawing Sheets

WATER-COOLED ENGINE

RELATED APPLICATION DATA

The Japanese priority application No. 2004-97845 upon which the present application is based is hereby incorporated in its entirety herein by reference.

BACKGROUND OF THE INVENTION

1. Field of the Invention

The present invention relates to a water-cooled engine comprising: a cylinder having an axis extending generally horizontally; a piston slidably received in the cylinder to define a portion of a combustion chamber; a water jacket formed around the combustion chamber and having a cooling water outlet in its upper portion; and a water passage through which cooling water which has cooled a higher-temperature portion of the engine outside the water jacket is supplied to the water jacket.

2. Description of the Related Art

In general, a water-cooled engine is used as a vertical engine for an outboard engine system. In this type of the water-cooled engine, if a cylinder block and a cylinder head are equally cooled by cooling water, when the cylinder head of a relatively large heat release is cooled to an appropriate temperature, the cylinder block of a relatively small heat release value tends to be overcooled. Japanese Patent Application Laid-open No. 61-167111 discloses a cooling structure for an outboard engine system for cooling both a cylinder head and a cylinder block to an appropriate temperature, in order to overcome the above-described problem.

In each of embodiments and modifications (see FIG. 2, FIG. 2*a* to FIG. 2*c*, FIG. 3, FIG. 3*a* and FIG. 3*b*) described in this Japanese Patent Application Laid-open No. 61-167111, cooling water of a lower temperature from a cooling water pump is supplied to a water jacket in the cylinder head, and the cooling water consequently having a raised temperature is supplied to a water jacket in the cylinder block, thereby preventing the overcooling of the cylinder block while sufficiently cooling the cylinder head.

When cooling water is supplied to a water jacket having a cooling water outlet formed in its upper portion, if a cooling water inlet for supplying the cooling water to the water jacket is not disposed at an appropriate position, the cooling water flows downwards in a portion of the water jacket surrounding opposite left and right sides of a cylinder. Therefore, there is a possibility that the flow rate of the cooling water in various portions of the water jacket becomes uneven, resulting in a degraded cooling effect.

SUMMARY OF THE INVENTION

Accordingly, it is an object of the present invention to provide a uniform flow rate of cooling water flowing through various portions of a water jacket in a water-cooled engine including a cylinder having an axis extending generally horizontally, thereby enhancing the cooling effect.

In order to achieve the above-mentioned object, according to a first feature of the invention, there is provided a water-cooled engine comprising: a cylinder having an axis extending generally horizontally; a piston slidably received in the cylinder to define a portion of a combustion chamber; a water jacket formed around the combustion chamber and having a cooling water outlet in its upper portion; and a water passage through which cooling water which has cooled a higher-temperature portion outside the water jacket is supplied to the water jacket, wherein the water passage is in communication with a lower half of the water jacket.

According to a second feature of the present invention, in addition to the first feature, the water-cooled engine further comprises a plurality of the cylinders which are juxtaposed vertically, and the water passage is in communication with the water jacket in a position corresponding to the lower half of the lowermost cylinder.

A cooling water passage 11*f* in an embodiment corresponds to the cooling water outlet of the present invention; an exhaust passage 24 within an engine room in the embodiment corresponds to the higher-temperature portion of the present invention; a water supply pipe 71 in the embodiment corresponds to the water passage of the present invention; and a cylinder-block cooling water jacket JB in the embodiment corresponds to the water jacket of the present invention.

With the arrangement of the first feature, the cooling water warmed after cooling the higher-temperature portion is supplied to the water jacket formed around the combustion chamber, and hence it is possible to prevent a region around the combustion chamber from being overcooled. Because the cooling water from the higher-temperature portion is supplied to the lower half of the water jacket at this time, it is possible to minimize unevenness in the flow rate of the cooling water flowing through the water jacket on the opposite left and right sides of the cylinder toward the cooling water outlet provided at the upper portion thereof, thereby making uniform the distribution of the temperature around the combustion chamber.

With the arrangement of the second feature, the water passage is in communication with the water jacket in the position corresponding to the lower half of lowermost one of the plurality of cylinders juxtaposed vertically. Therefore, it is possible to cause the cooling water to flow equally through the water jacket on the opposite left and right sides of the plurality of cylinders, thereby achieving uniform distribution of the temperature around each of the combustion chambers.

The above and other objects, features and advantages of the invention will become apparent from the following description of the preferred embodiment taken in conjunction with the accompanying drawings.

DETAILED DESCRIPTION OF PREFERRED EMBODIMENT

Figure 1:
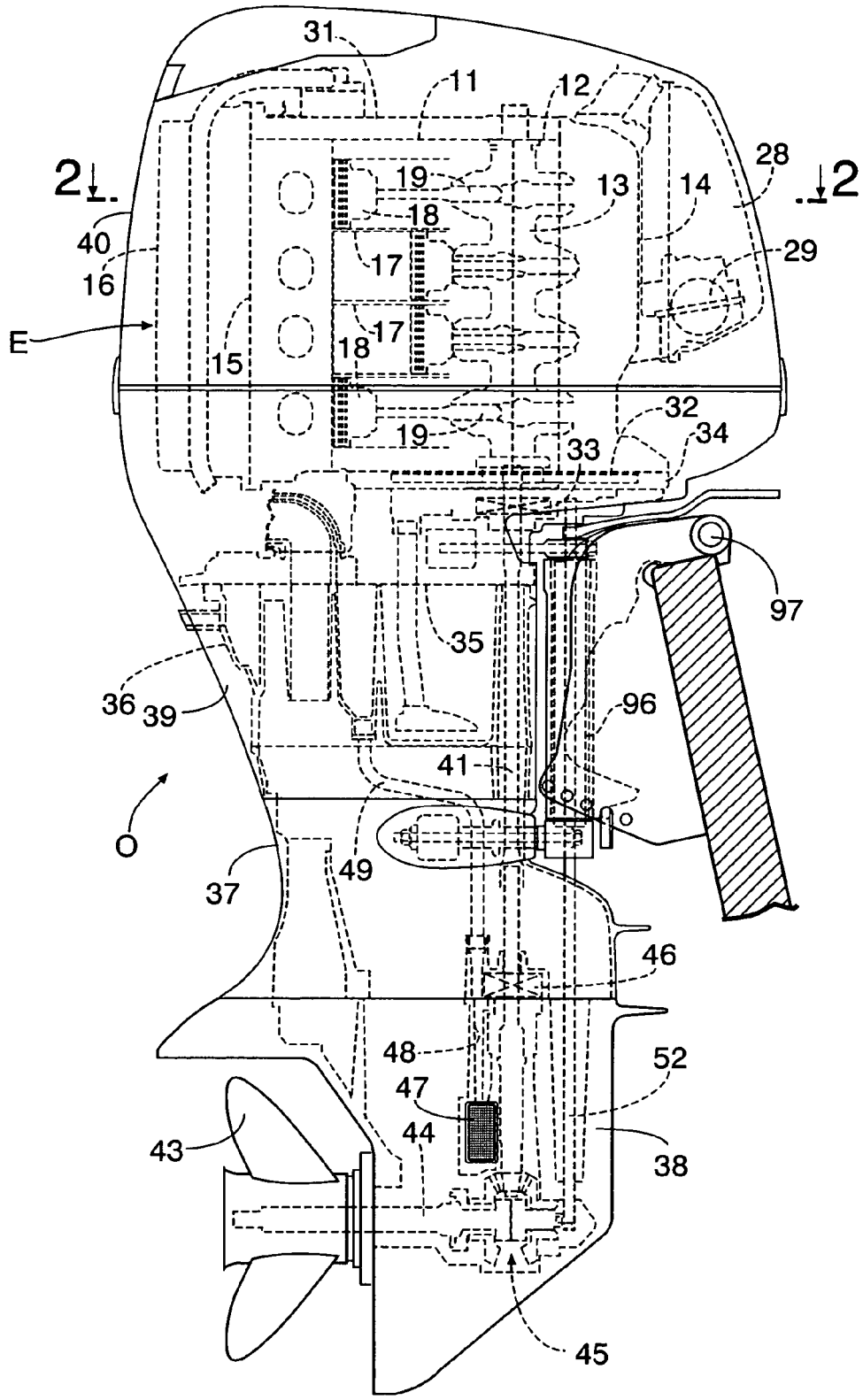
FIG. 1 is a side view of the entire arrangement of an outboard engine system including a water-cooled engine according to the present invention.

The present invention will now be described by way of an embodiment with reference to the accompanying drawings.

An outboard engine system O is mounted to a hull to make a steering motion laterally about a steering shaft 96 and to make a tiling motion vertically about a tiling shaft 97. A water-cooled vertical engine E of an in-line 4-cylinder and 4-stroke type mounted on an upper portion of the outboard engine system O, includes: a cylinder block 11; a lower block 12 coupled to a front surface of the cylinder block 11; a crankshaft 13 disposed in a generally vertical direction and supported so that its journals 13*a* are clamped between the cylinder block 11 and the lower block 12; a crankcase 14 coupled to a front surface of the lower block 12; a cylinder head 15 coupled to a rear surface of the cylinder block 11; and a head cover 16 coupled to a rear surface of the cylinder head 15. Pistons 18 slidably received within four sleeve-shaped cylinders 17 formed by enveloped-casting in the cylinder block 11 are connected to crankpins 13*b* of the crankshaft 13 through connecting rods 19, respectively.

Combustion chambers 20 formed in the cylinder head 15 so as to oppose to top surfaces of the pistons 18 are connected to an intake manifold 22 through intake ports 21 which open into a left side of the cylinder head 15, i.e., a port side in a traveling direction of a boat, and connected to an exhaust passage 24 within an engine room through exhaust ports 23 which open into a right side of the cylinder head 15. Intake valves 25 for opening and closing downstream ends of the intake ports 21 and exhaust valves 26 for opening and closing upstream ends of the exhaust ports 23 are driven by a DOHC-type valve-operating mechanism 27 accommodated within the head cover 16. An upstream portion of the intake manifold 22 is connected to a throttle valve 29 disposed in front of the crankcase 14 and fixed to a front surface of the crankcase 14, so that intake air having passed through a silencer 28 is supplied to the intake manifold 22. Injectors 58 for injecting fuel into the intake ports 21 are mounted on an injector base 57 clamped between the cylinder head 15 and the intake manifold 22.

A chain cover 31 is coupled to upper surfaces of the cylinder block 11, the lower block 12, the crankcase 14 and the cylinder head 15, and accommodates a timing chain (not shown) for transmitting a driving force from the crankshaft 13 to the valve-operating mechanism 27. An oil pump body 34 is coupled to lower surfaces of the cylinder block 11, the lower block 12 and the crankcase 14. A mount case 35, an oil case 36, an extension case 37 and a gear case 38 are coupled sequentially to a lower surface of the oil pump body 34.

An oil pump 33 is accommodated between a lower surface of the oil pump body 34 and an upper surface of the mount case 35. A flywheel 32 is disposed between the oil pump body 34 and a lower surface of the cylinder block 11 and the like on an opposite side from the oil pump body 34. A flywheel chamber and an oil pump chamber are partitioned by the oil pump body 34. A periphery of lower portions of the oil case 36, the mount case 35 and the engine E is covered with an undercover 39 made of a synthetic resin, and an upper portion of the engine E is covered with an engine cover 40 which is made of a synthetic resin and coupled to an upper surface of the undercover 39.

A drive shaft 41 connected to a lower end of the crankshaft 13 extends downwards through the pump body 34, the mount case 35 and the oil case 36 and within the extension case 37, and is connected to a front end of a propeller shaft 44 supported longitudinally in the gear case 38 and having a propeller 43 at its rear end through a forward and backward movement switchover mechanism 45 operated by a shifting rod 52. A lower water supply passage 48 extending upwards from a strainer 47 mounted in the gear case 38 is connected to a cooling water pump 46 mounted on the drive shaft 41. An upper water supply pipe 49 extending upwards from the cooling water pump 46 is connected to a cooling water passage 36*b* through a cooling water supply bore 36*a* provided in the oil case 36.

The cooling water supply bore 36*a* is formed in a lower surface 36L of the oil case 36. The upper water supply pipe 49 is connected at its upper end to the cooling water supply bore 36*a*. The cooling water passage 36*b* leading to the cooling water supply bore 36*a* is formed in an upper surface 36U of the oil case 36 so as to surround a portion of a periphery of an exhaust pipe portion 36*c* integrally formed on the oil case 36. A cooling water passage 35*a* having the same shape as the cooling water passage 36*b* in the upper surface 36U of the oil case 36 coupled to a lower surface 35L of the mount case 35 is formed to surround a portion of a periphery of an exhaust passage 35*b* extending through the mount case 35. Cooling water supply passages 35*c* and a cooling water discharge passage 35*d* surround an outer periphery of the exhaust passage 35*b*. The cooling water discharge passage 35*d* communicates with an exhaust chamber 63 formed within the oil case 36, the extension case 37 and the gear case 38.

A cooling water supply passage 35*e* is formed to have a groove-like U-shaped section in the supper surface 35U of the mount case 35. The cooling water passage 35*a* extends upwards and communicates with the cooling water supply passage 35*e*. A relief valve 51 is mounted on the upper surface 35U of the mount case 35, and adapted to be opened to discharge cooling water when the pressure in the cooling water passage 35*a* reaches a predetermined value or higher.

The structure of the exhaust passage 24 within the engine room will be described below.

An exhaust passage means is divided mainly into a section of the exhaust passage 24 within the engine room, and an exhaust chamber section partitioned from the engine room. The exhaust passage 24 within the engine room includes: an exhaust manifold 61 having single-pipe portions 61*a* which are coupled to a right side of the cylinder head 15 and into which an exhaust gas from each of the combustion chambers 20 is introduced, and a collecting portion 61*b* in which the single-pipe portions 61*a* are joined together in a downstream region; and an exhaust guide 62 connected at a coupled portion 62*a* to the exhaust manifold 61 and adapted to guide the exhaust gas to the outside of the engine room. The exhaust guide 62 is coupled to the upper surface 35U of the mount case 35 constituting a partition wall of the engine room, and communicates with the exhaust passage 35*b* extending through the mount case 35.

Formed in the exhaust guide 62 are a first exhaust-guide cooling water jacket JM1 covering a upper-surface side half of a periphery of an exhaust passage 62*d* in the exhaust guide 62 to surround the exhaust passage 62*d*, and a second exhaust-guide cooling water jacket JM3 covering a lower-surface side half of the periphery. An exhaust-manifold cooling water jacket JM2 is formed to surround a periphery of the exhaust manifold 61, and communicates at its lower end with an upper end of the first exhaust-guide cooling water jacket JM1 on the exhaust guide 62.

The exhaust manifold 61 is provided, at an upper portion of the exhaust-manifold cooling water jacket JM2, with a coupling 61*d* for dispensing a portion of the cooling water to the cylinder block 11, and a coupling 61*e* for supplying a portion of the cooling water to a water-examining port 66 through a hose 65.

The structure of a cooling system for the cylinder block 11 will be described below.

The cooling water having a temperature raised after having passed through the first exhaust-guide cooling water jacket JM1 in the exhaust guide 62 and the exhaust-manifold cooling water jacket JM2 on the exhaust manifold 61 and having cooled the exhaust passage 24 within the engine room, is supplied from the coupling 61*d* provided at an upper end of the exhaust-manifold cooling water jacket JM2 on the exhaust manifold 61 via the water supply pipe 68 to a branch member 69 comprising a T-shaped three-way joint, and is then diverted from the branch member 69 into two water supply pipes 70 and 71. A cylinder-block cooling water jacket JB is formed in the cylinder block 11 to surround the four cylinders 17.

Couplings 11*a* and 11*b* are mounted at a location closer to an upper end of the cylinder-block cooling water jacket JB (on a side portion of the second combustion chamber 20 from uppermost one) and at a location closer to a lower end (below the center of the lowermost combustion chamber 20, i.e., a cylinder axis). The upper water supply pipe 70 is connected to the upper coupling 11*a*, and the lower water supply pipe 71 is connected to the lower coupling 11*b*. In this manner, the exhaust-manifold cooling water jacket JM2 and the cylinder-block cooling water jacket JB are connected to each other by the water supply pipes 68, 70 and 71, and hence it is easy to form the water jackets by machining, as compared with a case where cooling-water supply passages are formed in the cylinder block 11 and the cylinder head 15.

A slit-shaped cooling water passage 34*a* (see FIG. 6) formed to pass through the pump body 34 communicates with the slit-shaped cooling water supply passage 35*e* (see FIG. 6) formed to pass through the mount case 35, and with a cooling water passage 11*c* (see FIGS. 3 and 6) formed in the lower surface of the cylinder block 11 and having the same mating face shape as the cooling water supply passage 35*e*. The cooling water passage 11*c* in the cylinder block 11 is in the form of a groove with its lower surface opened, and communicates with a lower end of the cylinder-block cooling water jacket JB in the cylinder block 11 through two through-holes lid and 11*e* (see FIG. 3) passing through an upper wall of the groove.

The cooling water flowing through the cylinder-block cooling water jacket JB in the cylinder block 11 is supplied to a thermostat which will be described hereinafter through a cooling water passage 11*f* formed in a left side of an upper portion of the cylinder block 11.

The structure of a cooling system for the cylinder head 15 will be described below.

Two short cooling water passages 11*g* and 11*h* (see FIG. 3) are branched from a sidewall of the cooling water passage 11*c* formed in the lower surface of the cylinder block 11 toward the cylinder head 15, and communicate with a cylinder-head cooling water jacket JH in the cylinder head 15 through a gasket 56 between the cylinder block 11 and the cylinder head 15.

Figure 2:
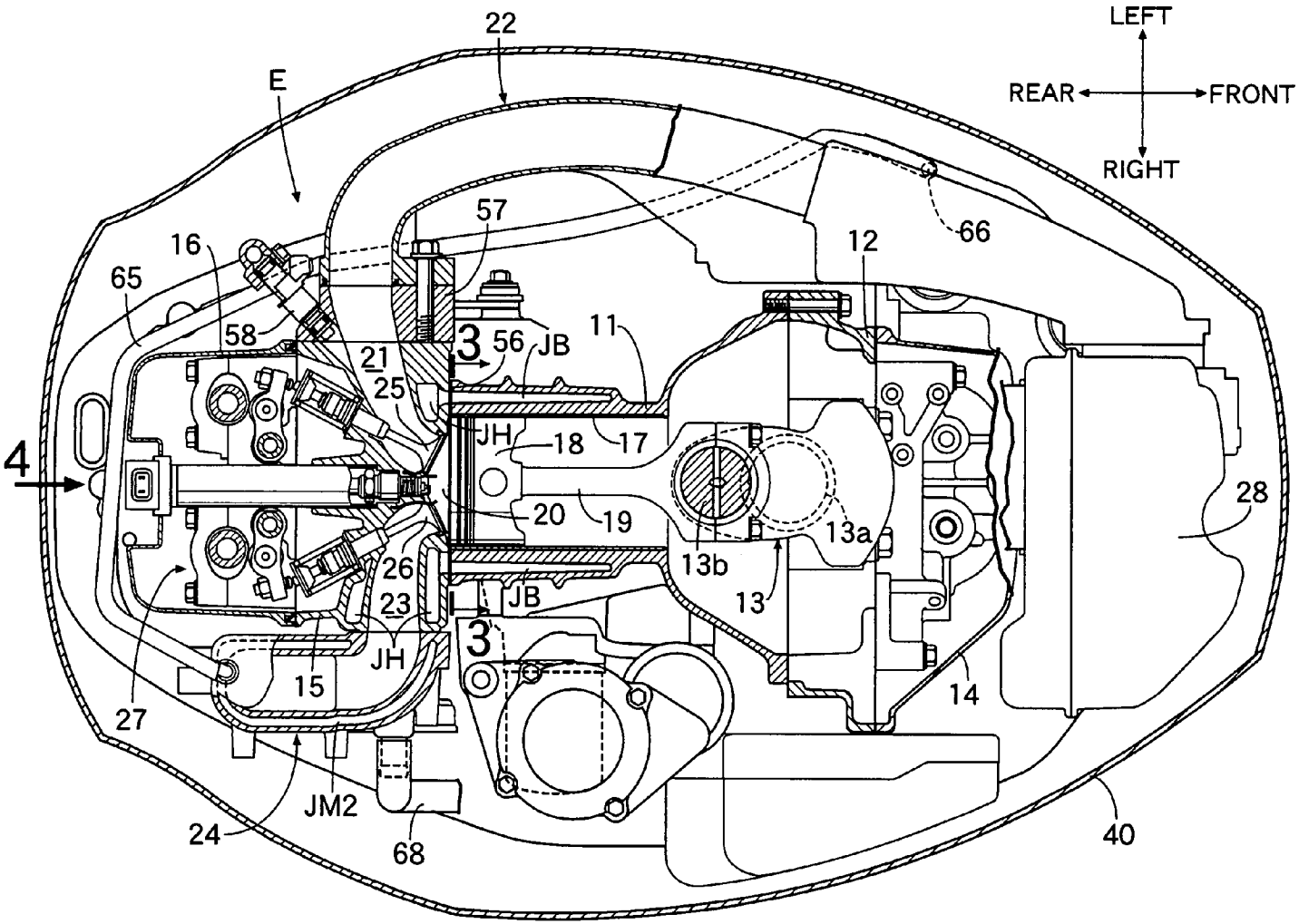
FIG. 2 is an enlarged sectional view taken along a line 2—2 in FIG. 1.
Figure 6:
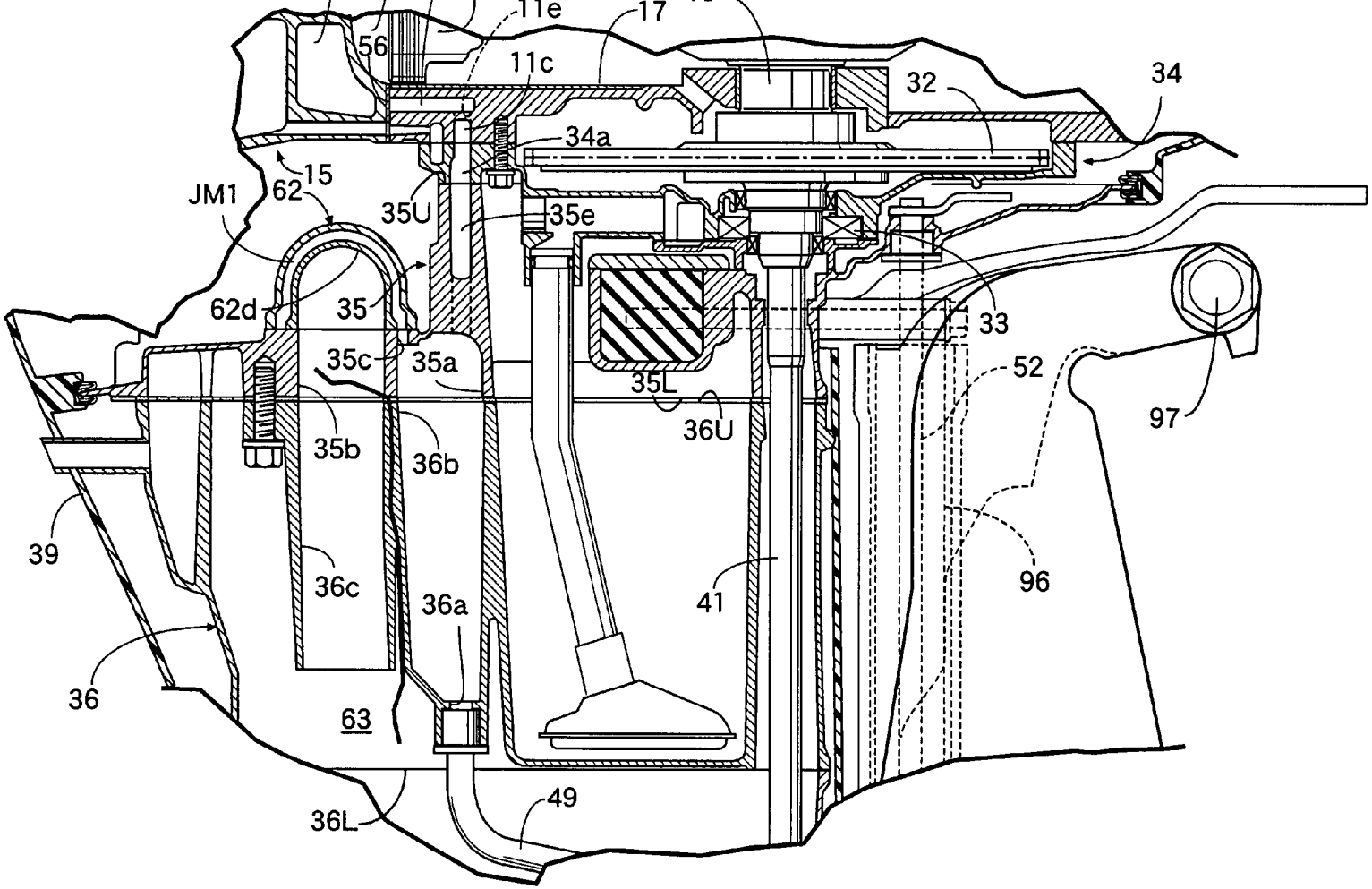
FIG. 6 is an enlarged sectional view of essential portions of FIG. 1.

The cylinder-block cooling water jacket JB surrounding the cylinders 17 in the cylinder block 11 is isolated from the cylinder-head cooling water jacket JH in the cylinder head 15 by the gasket 56 interposed between coupled surfaces of the cylinder block 11 and the cylinder head 15 (see FIGS. 2 and 6).

Figure 5:
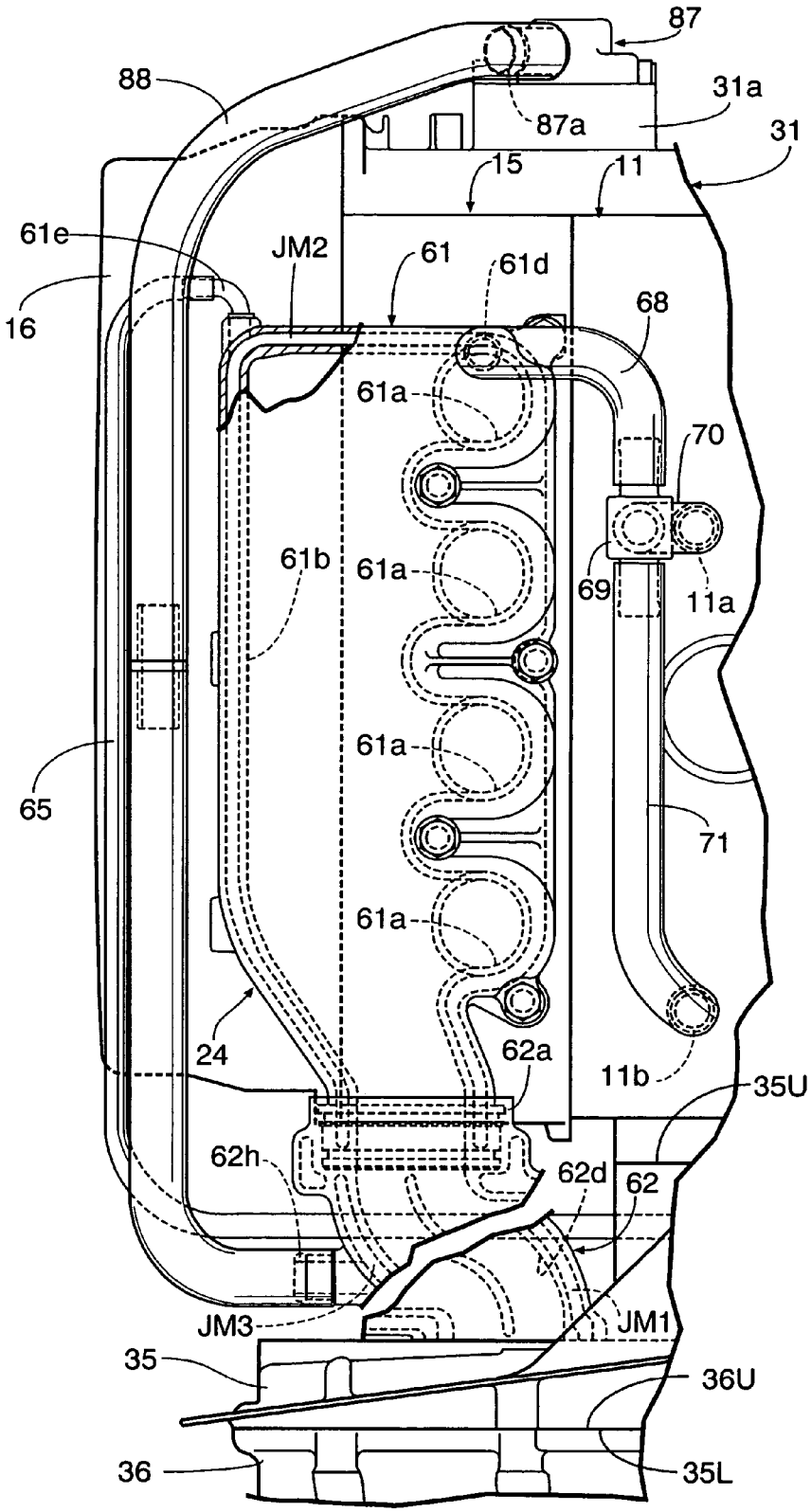
FIG. 5 is a view taken in a direction of an arrow 5 in FIG. 4.

Mounted within a thermostat-mounting seat 31*a* (see FIG. 5) of the chain cover 31 are a first thermostat 84 (see FIG. 7) leading to an upper portion of the cylinder-block cooling water jacket JB through a cooling water passage 11*f*, and a second thermostat 85 (see FIG. 7) leading to an upper portion of the cylinder-head cooling water jacket JH through a cooling water passage 15*b*. A coupling 87*a* provided on a thermostat cover 87 covering both the thermostats 84 and 85 is connected to the second exhaust-guide cooling water jacket JM3 through a water discharge pipe 88 and a coupling 62*h* provided on the exhaust guide 62.

Figure 7:
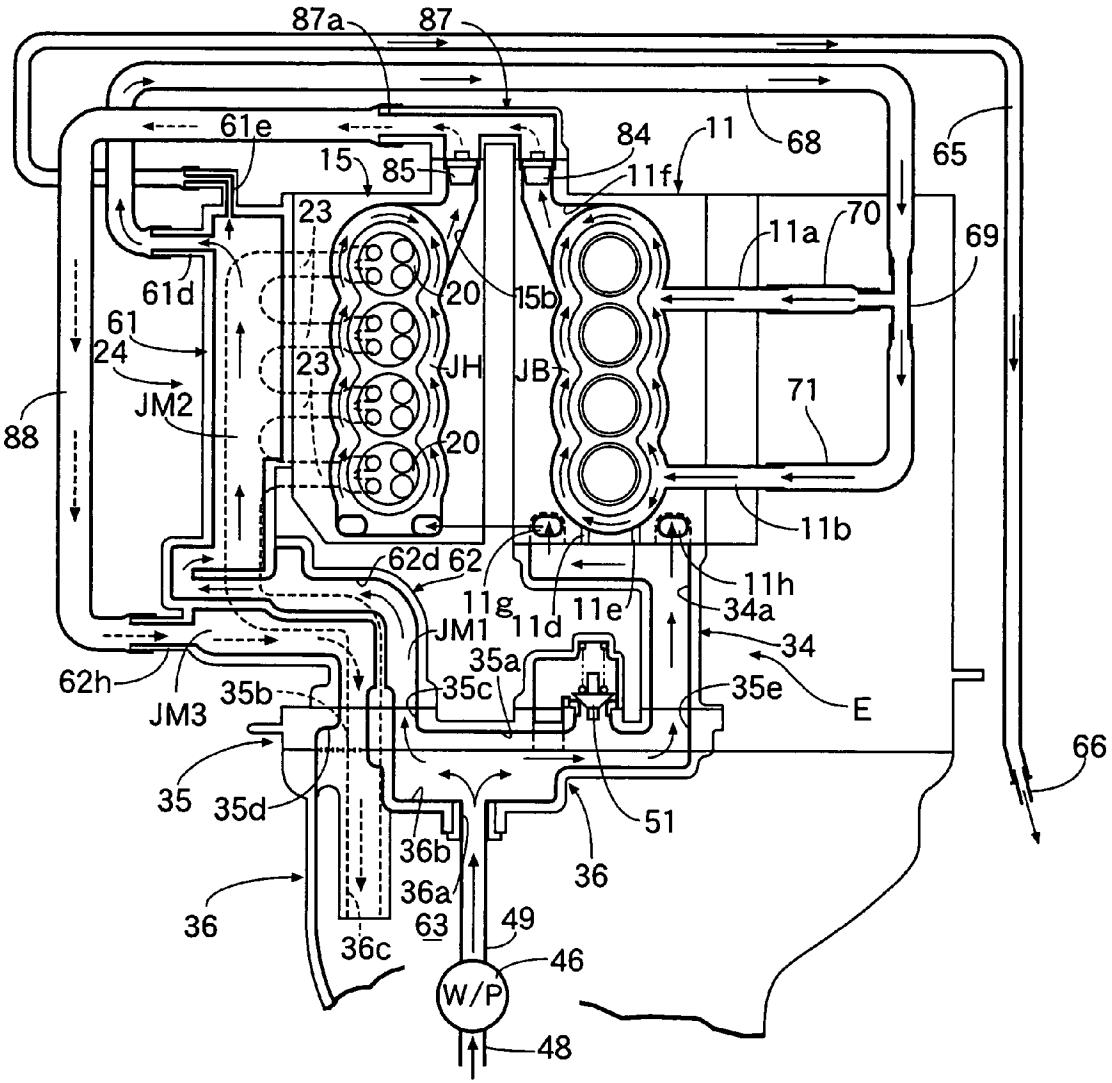
FIG. 7 is a circuit diagram of an engine-cooling system.

The operation of the embodiment of the present invention having the above-described arrangement will be described mainly with reference to FIG. 7.

When the drive shaft 41 connected to the crankshaft 13 is rotated by the operation of the engine E, the cooling water pump 46 mounted on the drive shaft 41 is operated to draw up through the strainer 47 and supply the cooling water to the cooling water supply port 36*a* in the lower surface of the oil case 36 through the lower water supply passage 48 and the upper water supply pipe 49. The cooling water having passed through the cooling water supply port 36*a* flows into the cooling water passage 36*b* in the upper surface 36U of the oil case 36 and the cooling water passage 35*a* in the lower surface 35L of the mount case 35. A portion of the cooling water diverted therefrom is supplied to the first exhaust-guide cooling water jacket JM1 formed in the exhaust guide 62 in the exhaust passage 24 within the engine room and the exhaust-manifold cooling water jacket JM2 formed around the exhaust manifold 61. The exhaust gas discharged from the combustion chambers 20 in the cylinder head 15 is discharged into the exhaust chamber 63 via the single-pipe portions 61*a* and the collecting portion 61*b* of the exhaust manifold 61, the exhaust passage 62*d* in the exhaust guides 62, the exhaust passage 35*b* in the mount case 35 and the exhaust pipe portion 36*c* of the oil case 36. The exhaust passage 24 within the engine room heated to a high temperature by the exhaust gas during this process is cooled by the cooling water flowing through the first exhaust-guide cooling water jacket JM1 and the exhaust-manifold cooling water jacket JM2.

The cooling water flowing upwards from blow through the first exhaust-guide cooling water jacket JM1 and the exhaust-manifold cooling water jacket JM2 to consequently have a slightly raised temperature is diverted from the coupling 61*d* provided at the upper end of the exhaust manifold 61, via the water supply pipe 68 and the branching member 69, into the two water supply pipes 70 and 71; and then flows, via the couplings 11*a* and 11*b* provided in the cylinder block 11, into a lower portion and an upper portion of a side face of the cylinder-block cooling water jacket JB. At this time, a portion of the cooling water having a lower temperature in each of the cooling water passages 36*b* and 35*a* flows, through the two through-holes 11*d* and 11*e* opening into the cooling water passage 11*c* at the lower end of the cylinder block 11, into the lower end of the cylinder-block cooling water jacket JB. A portion of the cooling water having the lower temperature from each of the cooling water passages 36*b* and 35*a* flows from the cooling water passage 11*c* at the lower end of the cylinder block 11, via the two cooling water passages 11*g* and 11*h*, into the lower end of the cylinder-head cooling water jacket JH.

During warming-up operation of the engine E, the first thermostat 84 leading to the upper end of the cylinder-block cooling water jacket JB and the second thermostat 85 leading to the upper end of the cylinder-head cooling water jacket JH are closed, and hence the cooling water in each of the first exhaust-guide cooling water jacket JM1, the exhaust-manifold cooling water jacket JM2, the cylinder-block cooling water jacket JB and the cylinder-head cooling water jacket JH stays there without flowing, thereby promoting the warming-up of the engine. During this time, the cooling water pump 46 continues to rotate, but is brought into substantially an idle running due to the leakage of the cooling water from the periphery of an impeller of the pump 46 made of a rubber.

When the warming-up operation of the engine E has been completed, resulting in a rise in temperature of the cooling water, the first and second thermostats 84 and 85 are opened, thereby permitting the cooling water in the cylinder-block cooling water jacket JB and the cooling water in the cylinder-head cooling water jacket JH to flow from the common coupling 87*a* of the thermostat cover 87, via the water discharge pipe 88 and the coupling 62*h* of the exhaust guide 62, into the second exhaust-guide cooling water jacket JM3. The cooling water which has cooled the exhaust guide 62 while flowing through the second exhaust-guide cooling water jacket JM3 is passed downwards from above through the mount case 35 and the oil case 36, to be discharged into the exhaust chamber 63. When the rotational speed of the engine E is increased, so that the internal pressure in each of the cooling water passages 36*b* and 35*a* reaches a predetermined value or higher, the relief valve 51 is opened to permit the surplus cooling water to be discharged into the exhaust gas chamber 63.

As described above, the cylinder-block cooling water jacket JB and the cylinder-head cooling water jacket JH are mounted independently from each other; the cooling water having a lower temperature is supplied directly to the cylinder-head cooling water jacket JH liable to be overheated during the operation of the engine E; and the cooling water having passed through the first exhaust-guide cooling water jacket JM1 and the exhaust-manifold cooling water jacket JM2 to consequently have the raised temperature is supplied to the cylinder-block cooling water jacket JB liable to be overcooled during the operation of the engine E. Therefore, each of the cylinder head 15 and the cylinder block 11 can be cooled to an appropriate temperature, whereby the performance of the engine E can be exhibited to the maximum. Moreover, because the thermostats 84 and 85 are mounted in the cylinder-block cooling water jacket JB and the cylinder-head cooling water jacket JH, respectively, the temperatures of the cooling water in the cylinder-block cooling water jacket JB and the cooling water in the cylinder-head cooling water jacket JH can be independently controlled as desired.

Figure 3:
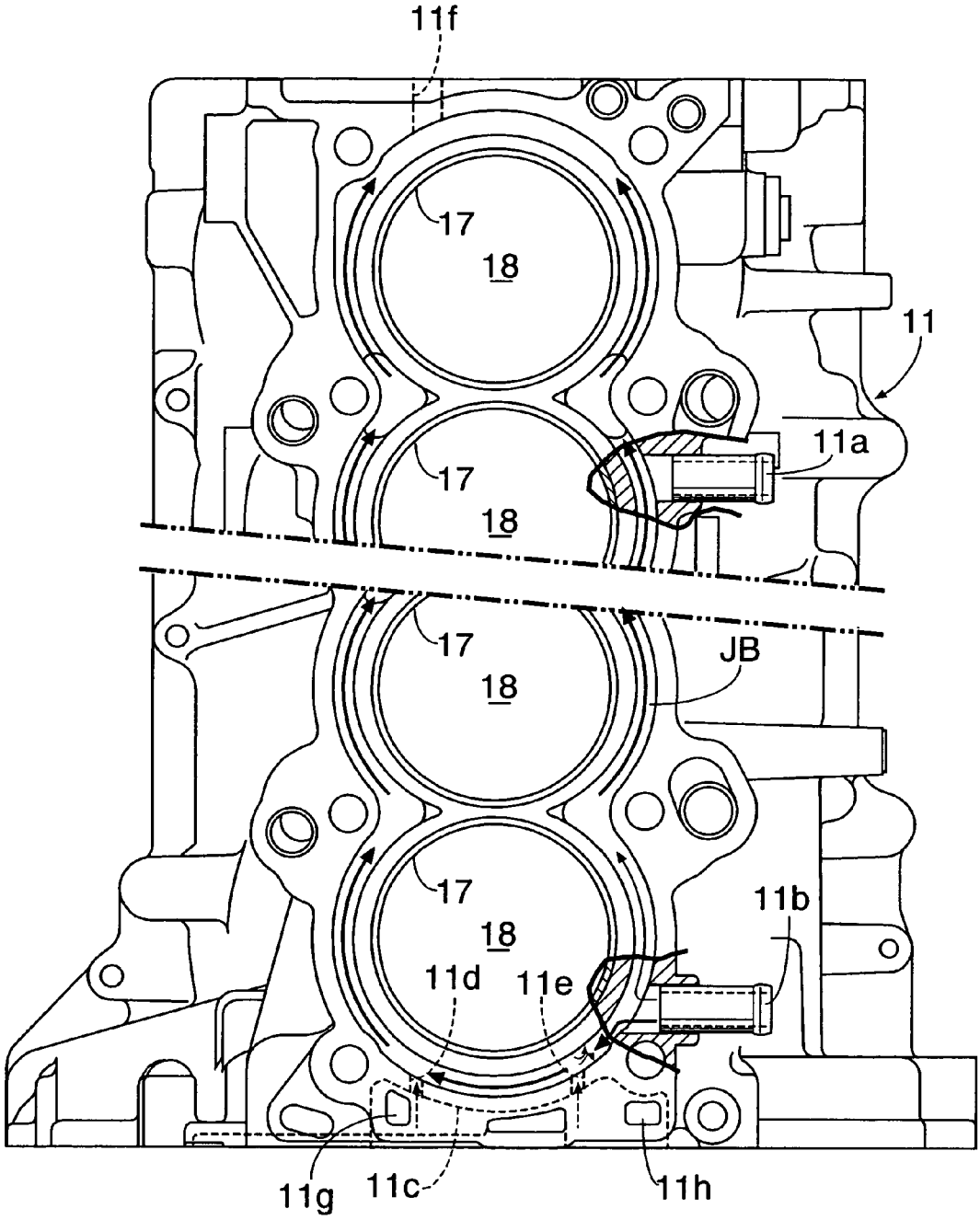
FIG. 3 is an enlarged sectional view taken along a line 3—3 in FIG. 2.
Figure 4:
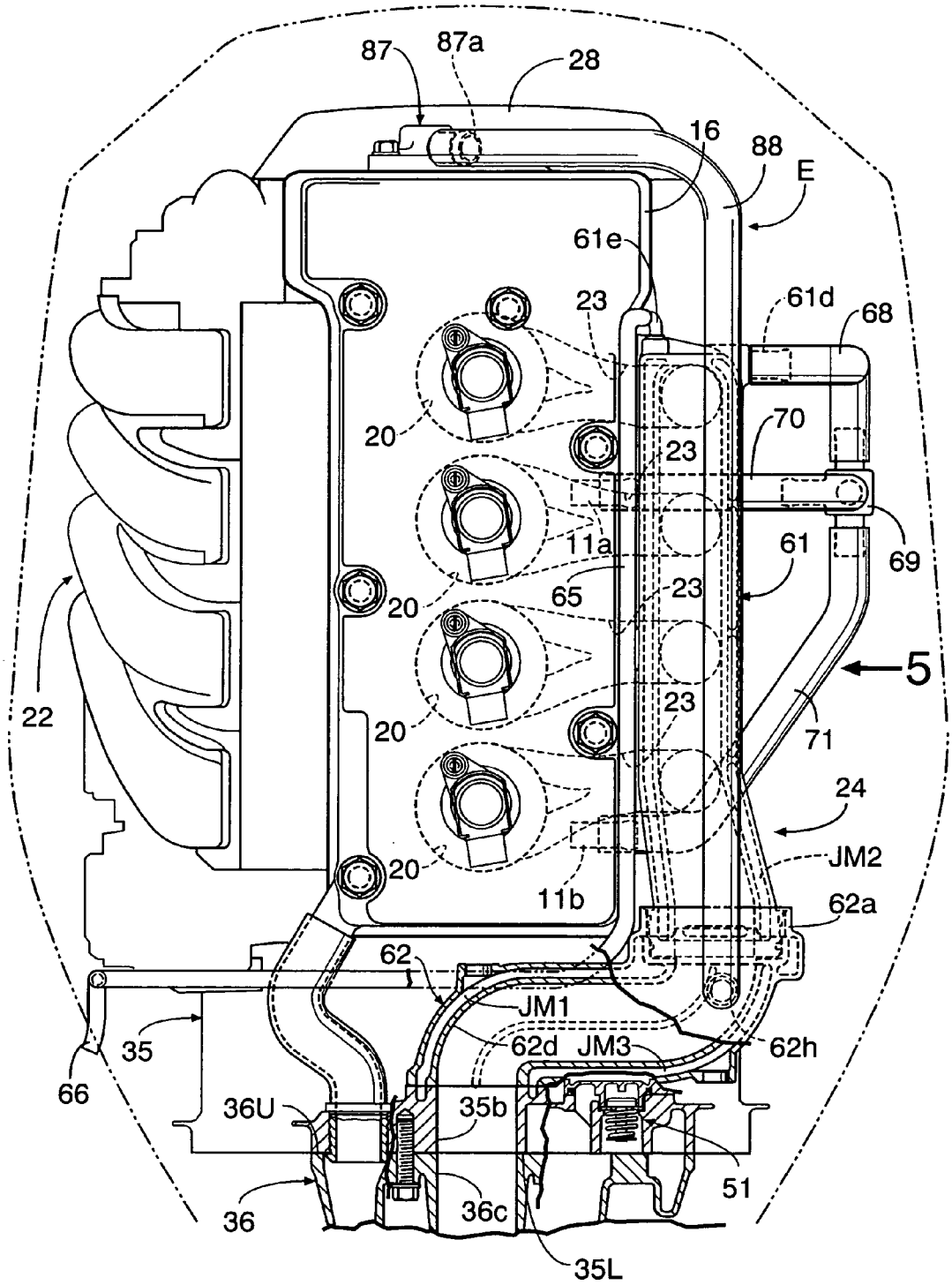
FIG. 4 is a view taken in a direction of an arrow 4 in FIG. 2.

Referring to FIG. 3, if the position of lower one 11*b* of the upper and lower couplings 11*a* and 11*b*, through which the cooling water having passed through the exhaust-manifold cooling water jacket JM2 is supplied to the cylinder-block cooling water jacket JB, is distant largely upwards from the lowermost portion of the cylinder-block cooling water jacket JB, a portion of the cooling water once flows downwards to reach the lowermost portion and then changes its course to flow upwards, and a remaining portion of the cooling water flows upwards directly from the lower coupling 11*b*. Therefore, there is a possibility that the flow rate of the cooling water flowing through the cylinder-block cooling water jacket JB becomes uneven on the opposite left and right sides of the cylinders 17.

In the present embodiment, however, because the lower coupling 11*b* is mounted in the position closer to the lowermost portion of the cylinder-block cooling water jacket JB, specifically below the center of the lowermost cylinder 17, i.e., below the cylinder axis, the flow rate of the cooling water flowing through the cylinder-block cooling water jacket JB can be made uniform on the opposite left and right sides of the cylinders 17, leading to an enhancement in cooling effect for the cylinder block 11.

In addition, because the cooling water passage 11*f* for discharging the cooling water is provided in the upper portion of the cylinder-block cooling water jacket JB, if the cooling water is supplied only from the lower coupling 11*b*, there is a possibility that the distribution of the temperature of the cooling water is lower at the lower portion and higher at the upper portion, so that the cooling effect for the cylinder block 11 is uneven in a vertical direction. According to the present embodiment, however, the cooling effect for the cylinder block 11 can be made uniform in the vertical direction by supplying the cooling water also from the upper coupling 11*a* to the cylinder-block cooling water jacket JB.

Even if fresh cooling water is supplied due to a sudden increase in rotational speed of the engine, this cooling water is supplied to the cylinder-block cooling water jacket JB in a temperature-raised state after passing through the first exhaust-guide cooling water jacket JM1 and the exhaust-manifold cooling water jacket JM2. Therefore, it is possible to appropriate the sudden change in temperature around each of the combustion chambers 20.

Further, it is possible to prevent the residence of the cooling water within the cylinder block-cooling water by supplementarily supplying the cooling water to the lower end of the cylinder-block cooling water jacket JB through the two through-holes 11*d* and 11*e*, thereby making further uniform the cooling performance. Moreover, because the through-holes 11*d* and 11*e* are provided in the lower end of the cylinder-block cooling water jacket JB, it is easy to treat the residual water during stoppage of the engine.

Although the embodiment of the present invention has been described in detail, the present invention is not limited to the above-described embodiment, and various modifications in design may be made without departing from the subject matter of the invention defined in the claims.

For example, the multi-cylinder engine E has been illustrated in the embodiment, but the present invention is also applicable to a single-cylinder engine.

In addition, the water-cooled engine E for the outboard engine system has been illustrated in the embodiment, but the present invention is also applicable to a water-cooled engine for other applications.

Further, in the embodiment, the lower coupling 11*b* through which the cooling water from the exhaust-manifold cooling water jacket JM2 is supplied to the cylinder-block cooling water jacket JB is mounted in the position corresponding to the lower half of the lowermost cylinder, but may be mounted in any position in the lower half of the cylinder-block cooling water jacket JB to achieve the desired effect.

What is claimed is:

1. A water-cooled engine of an in-line type comprising:

a plurality of cylinders juxtaposed vertically in a cylinder block and each said cylinder having an axis extending generally horizontally;

a plurality of pistons slidably received in associated ones of the cylinders to define portions of combustion chambers;

a water jacket formed around the combustion chambers and having a cooling water outlet in its upper portion; and a water passage through which cooling water which has cooled a higher-temperature portion outside the water jacket is supplied to the water jacket, wherein the water passage is defined by a pipe located outside a side face of the cylinder block and in communication with the water jacket in a position corresponding to a lower half of a lowermost one of the cylinders.

2. A water-cooled engine according to claim 1, further comprising a crankshaft disposed in a substantially vertical direction.

3. A water-cooled engine according to claim 1, further comprising a through hole connecting the water passage with a lower portion of the water jacket.

4. A water-cooled engine comprising:

a cylinder having a combustion chamber;

a cylinder head;

an exhaust manifold;

a combustion chamber water jacket formed around the combustion chamber and having a cooling water outlet in its upper portion;

a cylinder-head water jacket formed around the cylinder head;

an exhaust manifold water jacket formed around the exhaust manifold;

a water passage; and a cooling water passage;

wherein the water passage connecting an inlet of the exhaust manifold water jacket and an inlet of the cooling water passage;

an outlet of the exhaust manifold water jacket being connected to a lower portion of the combustion chamber water jacket; and an outlet of the cooling water passage being connected to the cylinder-head water jacket.

5. A water-cooled engine according to claim 4, comprising a plurality of the cylinders which are juxtaposed vertically, and each having an associated combustion chamber, and the combustion chamber water jacket is formed around all of the combustion chambers and the exhaust manifold water jacket is in communication with the combustion chamber water jacket in a position corresponding to a lower half of a lowermost one of said cylinders.

6. A water-cooled engine according to claim 5, further comprising a crankshaft disposed in a substantially vertical direction.

7. A water-cooled engine according to claim 4, further comprising a gasket isolating the combustion chamber water jacket from the cylinder-head water jacket.

8. A water-cooled engine according to claim 4, wherein said combustion chamber and cylinder-head water jackets include respective thermostats.

9. A water-cooled engine according to claim 8, wherein temperatures of water in each of said water jackets is controlled based on outputs of said thermostats.

10. A water-cooled engine according to claim 4, further comprising a water discharge pipe and each of the said water jackets is connected to the water discharge pipe.

11. A water-cooled engine comprising:

a cylinder having a piston slidably received in the cylinder to define a portion of a combustion chamber;

a cylinder head;

an exhaust manifold;

a cylinder-block water jacket formed around the combustion chamber;

a cylinder-head water jacket formed around the cylinder head;

a cooling water supply passage; and a water passage defined by a pipe located outside a side face of the cylinder;

wherein an outlet of the cooling water supply passage is connected to the cylinder-head water jacket; and the water passage provides cooling water which has cooled a higher-temperature portion of the engine to the cylinder-block water jacket.

12. A water-cooled engine according to claim 11, further comprising a gasket isolating the cylinder-block water jacket from the cylinder-head water jacket.

13. A water-cooled engine according to claim 11, wherein said cylinder-block and cylinder head water jackets include respective thermostats.

14. A water-cooled engine according to claim 13, wherein temperatures of water in each of said water jackets is controlled based on outputs of said thermostats.

15. A water-cooled engine according to claim 11, further comprising a through hole connecting the water supply passage with a lower portion of the cylinder-block water jacket.

16. A water-cooled engine according to claim 11, further comprising a plurality of the cylinders and the cylinder-block water jacket surrounds the plurality of cylinders.

* * * * *